US005287903A

United States Patent [19]

Ambasz

[11] Patent Number: 5,287,903

[45] Date of Patent: Feb. 22, 1994

[54] CARRYING BAGS

[76] Inventor: Emilio Ambasz, 295 Central Park West, New York, N.Y. 10024

[21] Appl. No.: 908,184

[22] Filed: Jul. 1, 1992

[51] Int. Cl.[5] ..... A45C 13/36

[52] U.S. Cl. ..... 150/129; 150/130; 383/112; 428/36.1

[58] Field of Search ..... 150/127, 129, 130; 190/21, 40, 103, 124, 125; 383/119, 112, 118; 428/35.7, 36.1

[56] References Cited

U.S. PATENT DOCUMENTS

| | | | |
|---|---|---|---|
| 338,475 | 3/1886 | Buchanan | 150/127 |
| 1,093,484 | 4/1914 | Schwarzrock | 190/125 X |
| 2,121,154 | 6/1938 | Landis | 150/127 |
| 2,428,972 | 10/1947 | Jackler et al. | 150/127 X |
| 2,435,784 | 2/1948 | Hoffman | 150/129 |
| 2,727,548 | 12/1955 | Kasdan | 150/129 X |
| 2,792,043 | 5/1957 | McLean | 150/129 X |
| 2,914,105 | 11/1959 | Kushynski et al. | 150/127 X |
| 3,902,541 | 9/1975 | Wardwell | 383/119 |
| 4,544,051 | 10/1985 | Saltz | 190/125 X |
| 4,977,941 | 12/1990 | Henderson | 150/129 |

FOREIGN PATENT DOCUMENTS

| | | | |
|---|---|---|---|
| 159811 | 4/1933 | Switzerland | 190/40 |

*Primary Examiner*—Allan N. Shoap
*Assistant Examiner*—Christopher McDonald
*Attorney, Agent, or Firm*—Brumbaugh, Graves, Donohue & Raymond

[57] ABSTRACT

A carrying bag comprises at least one extensible panel forming at least a part of the external walls of the bag. The extensible panel is of a composite material composed of a sheet of a stretch-knit fabric and a multiplicity of elongated strips of a durable, substantially non-extensible material joined to the fabric sheet in closely spaced relation by stitching located proximate to the centers of the strips, thereby leaving portions of the fabric sheet underlying the major portions of the strips free to stretch.

17 Claims, 5 Drawing Sheets

CARRYING BAGS

BACKGROUND OF THE INVENTION

People use carrying bags to carry around all sorts of things. There are the purses and handbags of many styles and constructions that virtually all women use for innumerable articles, briefcases and portfolios that office workers use, hand luggage for travel available in a wide range of sizes and styles, and all purpose bags, which are usually soft and made of leather or a fabric. (The term "carrying bags" is used herein in a broad sense to refer to purses, handbags, briefcases, luggage, and all purpose bags, as well as other articles that serve similar purposes, such a duffle bags, backpacks, toiletry cases, money pouches and so forth.) Carrying bags are often called upon to receive more articles than they are intended to hold or bulky articles that do not quite fit into them. Many people, therefore, like to have carrying bags that can expand or deform, and "soft" carrying bags of a fabric, such as canvas, or of natural or synthetic leather are very popular. Purses, portfolios and briefcases having pleated side and end walls that expand and contract, depending on the volume of material put into them, also meet this need.

Stretchable fabrics can be used for carrying bags, but are not entirely satisfactory for at least two reasons. First, stretchable fabrics are subject to mechanical failure, such as by tearing, if they are overloaded and stretched excessively; second, they lack durability against snags and tearing from contacting other objects, abrasion over time (natural wear and tear), and soiling.

SUMMARY OF THE INVENTION

An object of the present invention is to provide expandable carrying bags that are strong and durable, relatively inexpensive to produce, and highly attractive in appearance. A further object is to provide expandable carrying bags that, unlike soft carrying bags and many pleated carrying bags, retain their original size and shape except when they are expanded by filling them with enough articles to cause them to expand. Yet another object is to provide expandable carrying bags that are of self-sustaining shapes when empty or only partially filled.

The foregoing and other objects are attained, in accordance with the present invention, by carrying bags that have at least one extensible panel forming at least a part of the external walls of the bag. The extensible panel is of a composite material composed of a sheet of a stretch-knit fabric and a multiplicity of elongated strips of a durable, substantially non-extensible material joined to the fabric sheet in closely spaced relation by stitching located proximate to the centers of the strips, thereby leaving portions of the fabric sheet underlying the major portions of the strips free to stretch.

The strips stitched to the stretch-knit fabric contribute several important attributes to the composite material forming the extensible panel that the stretch-knit fabric does not have by itself, including:

- limiting the amount of stretching of the composite materials;
- imparting durability against damage to the stretch-knit fabric, such us from snagging, being cut or torn by impact, and normal wear and tear;
- enhancing the protection of the articles carried in the bags from impacts to the bags;

- imparting shape to the extensible material when the bags are empty or only partly loaded;
- providing a good appearance, such as by matching or complementing other materials used in the bags (for example, the strips may be of the same material as is used in other portions of the bag, such as natural or synthetic leather).

The extensible panel has opposite ends oriented transversely to the strips and opposite sides oriented transversely to the ends. In some embodiments, the ends of the extensible panel are joined to members forming portions of the bag that are substantially non-extensible so that stretching of the ends of the extensible panel in a direction transverse to the strips is substantially prevented. In other embodiments, the extensible panel is joined along its ends and sides to members that are substantially non-extensible and are inhibited from displacing relative to each other such that they restrict stretching of the extensible panel throughout.

Carrying bags such as briefcases and travel cases (luggage, for example) may have opposite side walls, opposite end walls, a top wall and a bottom wall, each of which walls is substantially rectangular; the extensible panel forms substantially all of at least one of the top and bottom walls. The side and end walls of the bag are, preferably, substantially rigid such that they restrict stretching of the extensible panel by inhibiting relative displacements of its ends and sides. Alternatively, the side and end walls of the bag may be substantially non-extensible but flexible such that they can displace relative to each other to permit the extensible panel to stretch by enabling relative displacements of its ends and sides but also inhibit stretching of the extensible panel by substantially preventing stretching along the edges and sides of the extensible panel.

In some embodiments, the bags have a top wall and a bottom wall bounded by smoothly curved margins and a peripheral wall joined to the top and bottom walls, the peripheral wall being the extensible panel of the bag. The strips may extend transversely to the top and bottom walls, and the bags may have a carrying strap attached to the bottom wall of the bag, such as a strap that is integral with oppositely located strips of the extensible panel.

In other embodiments, the bags have a substantially rigid bottom wall bounded by a smoothly curved margin and a peripheral wall joined to the bottom wall, the peripheral wall being the extensible panel of the bag and the strips extending circumferentially. A carrying strap is affixed to the bottom wall. A strip of the extensible panel adjacent the top of the bag has a multiplicity of holes and a cord passing through the holes forms a drawstring closure for the bag.

Another aspect of the present invention is a unique composite material composed of a sheet of a stretch-knit fabric and a multiplicity of elongated strips of a durable, substantially non-extensible material joined to the fabric sheet in closely spaced relation by stitching located proximate to the centers of the strips, thereby leaving portions of the fabric sheet underlying the major portions of the strips free to stretch. The strips are preferably of natural or synthetic leather.

For a better understanding of the invention, reference may be made to the following description of exemplary embodiments, taken in conjunction with the accompanying drawings.

DESCRIPTION OF THE EMBODIMENTS

Figure 1:
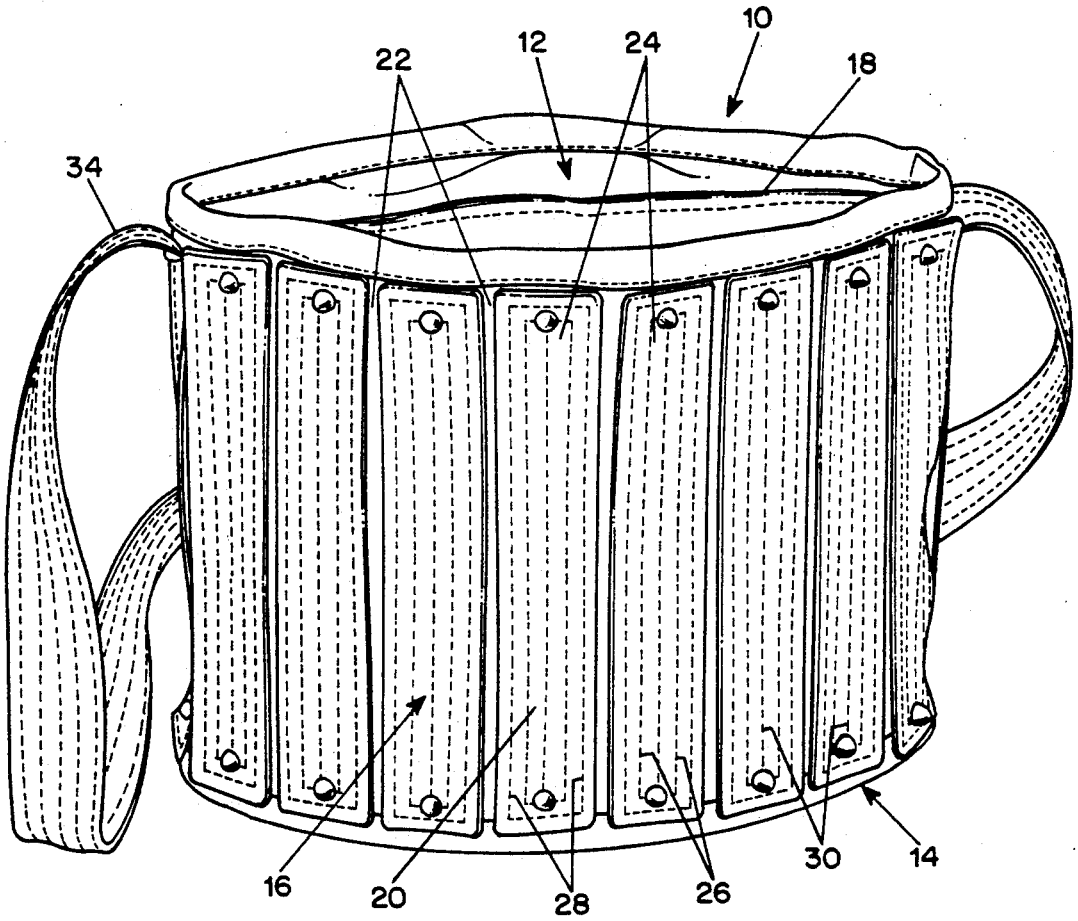
FIGS. 1 to 3 are pictorial views of three embodiments.

The embodiment of FIG. 1 is a handbag 10 having a top wall 12, a bottom wall 14 (of which only the edge is visible), and a peripheral wall 16 extending between the top and bottom walls. The top and bottom walls have smoothly curved margins, such as oval-shaped or elliptical. The bottom wall is substantially rigid, being composed, for example, of a fabric liner, a stiffener and a fabric outer cover. The top wall is a substantially non-extensible fabric and has an access opening that runs along the longer dimension and is closed by a zipper 18.

Figure 4:
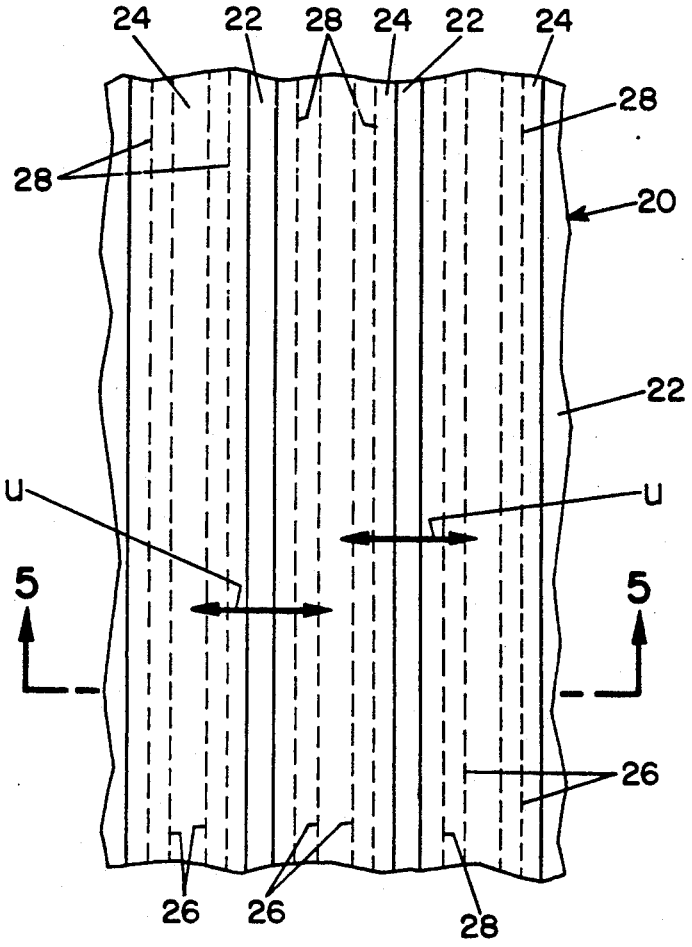
FIG. 4 is a plan view of a piece of a composite material useful as an extensible material of a carrying bag according to the invention.
Figure 5:
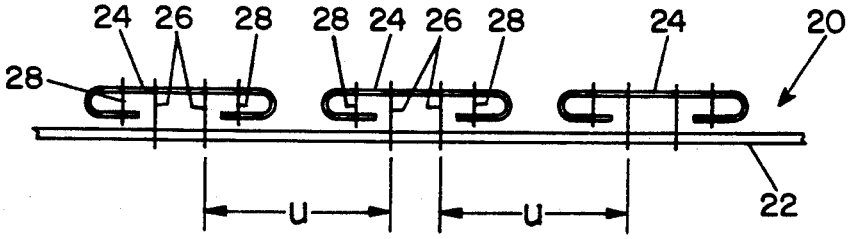
FIGS. 5 and 6 are end cross-sectional views, taken along the line 5—5 of FIG. 4, of the composite material of FIG. 4, showing it in the unstretched and stretched conditions, respectively.
Figure 6:
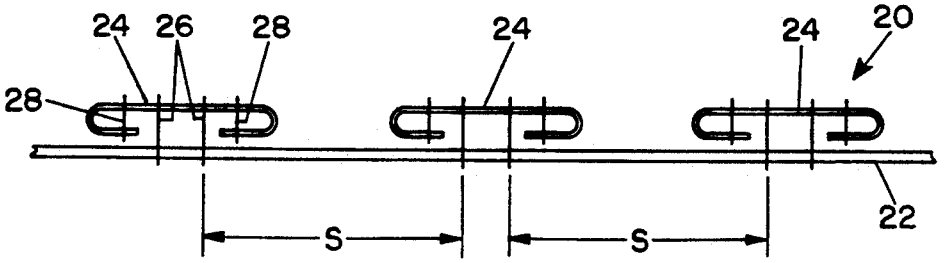

The peripheral wall 16 is a panel 20 of a composite material, an example of which is shown in detail in FIGS. 4 to 6. The material is composed of a stretchable knitted fabric sheet 22 and a multiplicity of elongated strips 24 of a durable, substantially non-extensible material joined to the fabric sheet in closely spaced relation by stitching 26 located proximate to the centers of the strips, thereby leaving portions of the fabric sheet underlying the major portions of the strips free to stretch. The strips are preferably of natural or synthetic leather and have their side and end edges folded under and stitched (stitching 28) to form hems around their entire perimeters. The strips run vertically between the top and bottom walls, and the panel is stitched to the top and bottom walls about their respective margins. The edges of the panel are, of course, stitched together where they meet (not shown).

The peripheral wall panel of the handbag of FIG. 1 differs slightly from that shown in FIGS. 4 and 5 in that it includes a decorative stitch line 30 running along the center, the stitching 26 that joins each strip 24 to the fabric sheet 22 being symmetrically located on either side of the stitch line 30. Decorative buttons or studs 32 are fastened to the peripheral wall near the top and bottom of each strip 24. Two strips 24 opposite each other across the long dimension of the handbag are integral portions of a carrying strap 34.

Figure 7:
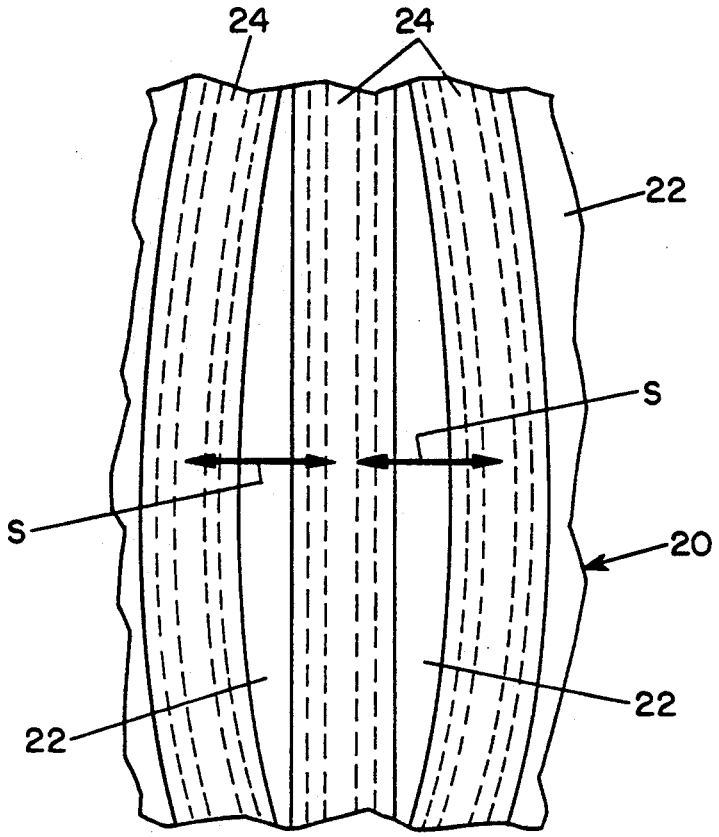
FIGS. 7 and 8 are plan views of pieces of the composite material of FIG. 4, showing different modes of stretching.

While the strips 24 are somewhat flexible, they have sufficient stiffness to give the bag shape when it is empty or only partly filled, as shown in FIG. 1. The load of articles carried in the handbag is supported mainly by the rigid bottom wall 14. When the handbag is filled beyond its volume in the unstretched condition of the composite material, the peripheral wall will bulge outwardly and take on a somewhat bulbous shape, a situation depicted in FIG. 7. The lines designated S represent stretching of the fabric element of the composite material, which occurs throughout most of the peripheral extent of the fabric element in a direction transverse to the strips 24, including portions underlying each side of each strip laterally outwardly of the stitching 26 by which the strips 24 are joined to the fabric 22. Because the top and bottom walls are non-extensible, the stretching of the fabric is inhibited near the top and bottom of the handbag, whereas stretching of the fabric 22 in regions remote from the top and bottom of the bag is not inhibited but is somewhat restrained by the residual influence of the inhibition of stretching provided by the non-extensible top and bottom walls. The construction of the bag is such that the strips 24, by joining together non-extensible the top and bottom walls, control the stretching of the fabric 22. Inasmuch as the top and bottom walls can displace toward each other, the bulging of the bag can occur as a result of outward flexure of the strips 24.

Figure 2:
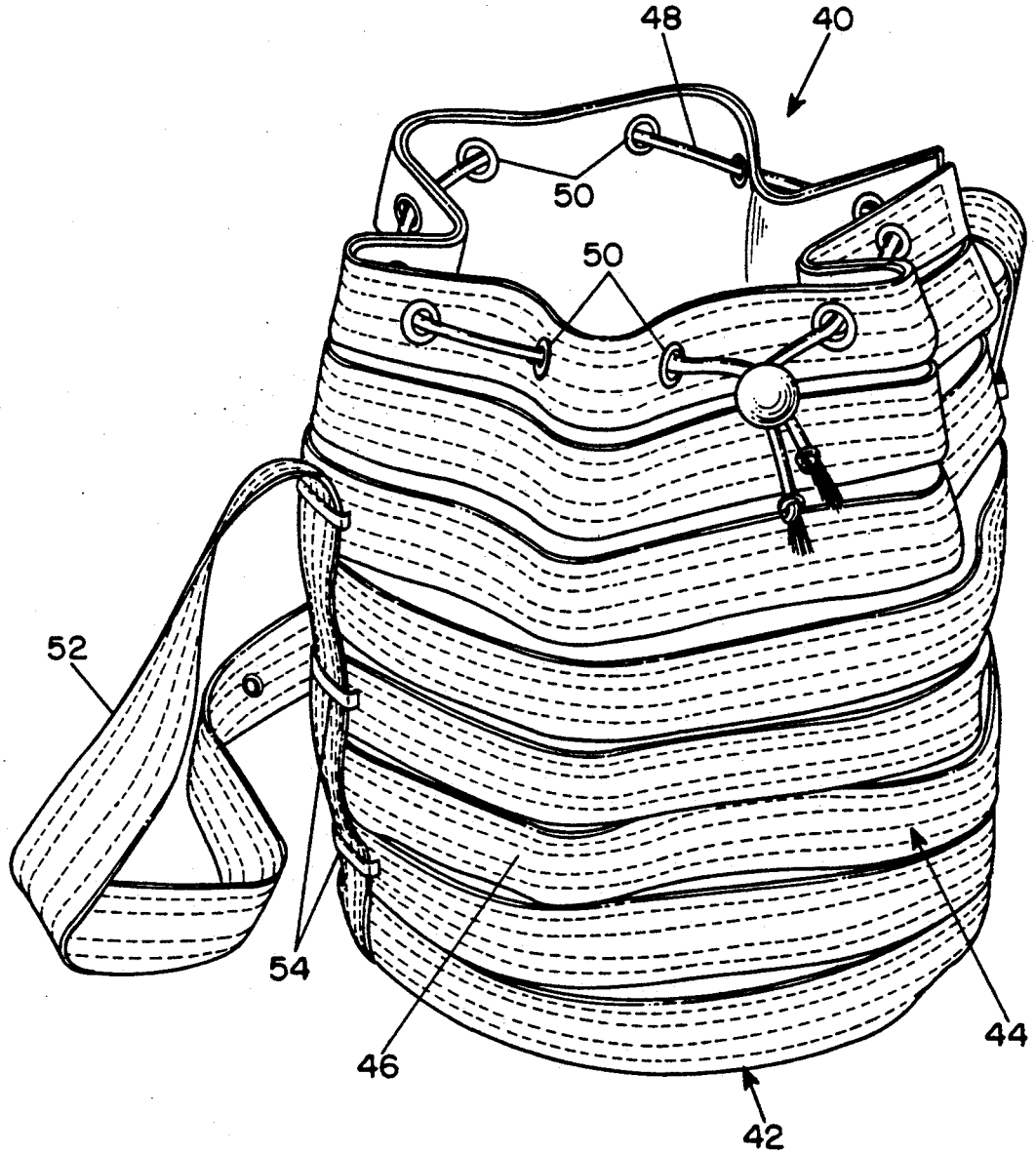

Another embodiment, also a handbag 40, is shown in FIG. 2. It has a round, substantially rigid bottom wall 42 and a peripheral wall 44 formed by a panel 46 of the composite material, which is exemplified by that shown in FIGS. 4 to 6 and is described above. In this case, the strips 24 extend circumferentially. The bottom edge of the panel 46 is stitched to the perimeter of the bottom wall of the bag, and the ends of the panel 46 where they meet are stitched together; the top of the bag is open but can be closed by a drawstring closure, which gathers in the top part of the peripheral wall and is formed by a rope 48 that passes in and out through grommetted holes 50 spaced apart along the uppermost strip 24 of the panel. A carrying strap 52 is attached to the bottom wall of the bag at diametrically opposite points and is connected loosely to some of the strips 24 of the peripheral wall by staples 54.

Figure 8:
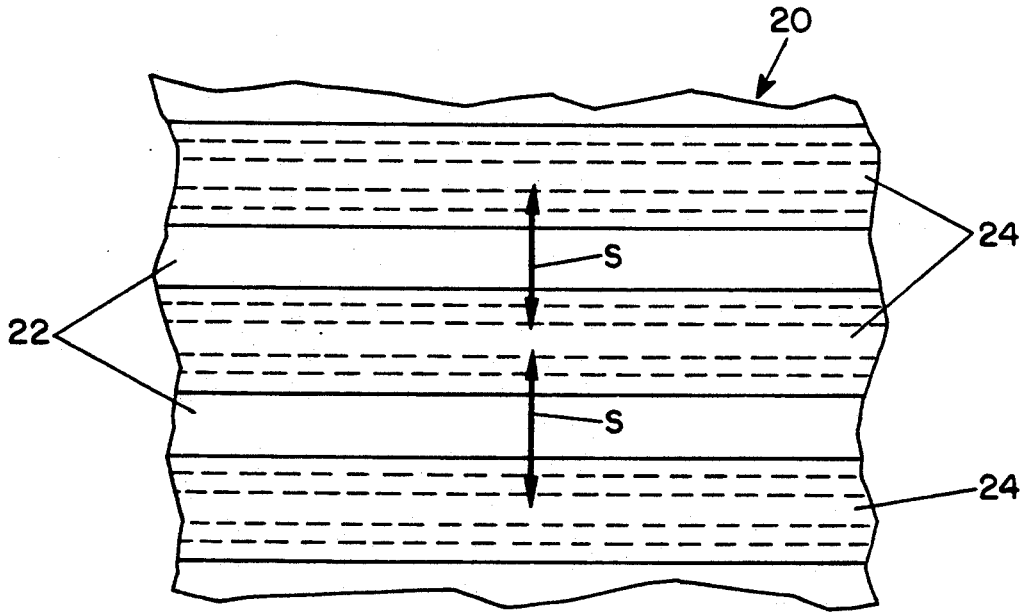

The strips 24 impart shape to the bag when it is not filled, although it tends to slump down somewhat because the strips extend peripherally. If the user stuffs a large volume of things into the bag, the peripheral wall can stretch in the vertical direction, as depicted by the lines S in FIG. 8, thus increasing the volume by allowing the bag to become taller. Assuming a fairly uniform distribution of the volume of articles, the stretching of the fabric element of the panel is generally uniform in the vertical direction. As the user loads the bag, she can pull up on the top edge of the peripheral wall to stretch it, and when it is full can do up the drawstring. Little stretching of the bag can occur in the circumferential direction, because the strips 24 of the composite material are only slightly extensible. A combination of stretching of the fabric element of the composite material, flexing of the strips 24, and relative displacements of the strips allows the bag to take on irregular shapes as may be required to accommodate the articles loaded into it. Because the carrying strap is attached to the bottom wall, the load of the articles in the bag is carried predominantly by the bottom wall. Vertical stretching of the peripheral wall is not inhibited by the strap, which is free to slide through the staples.

Figure 3:
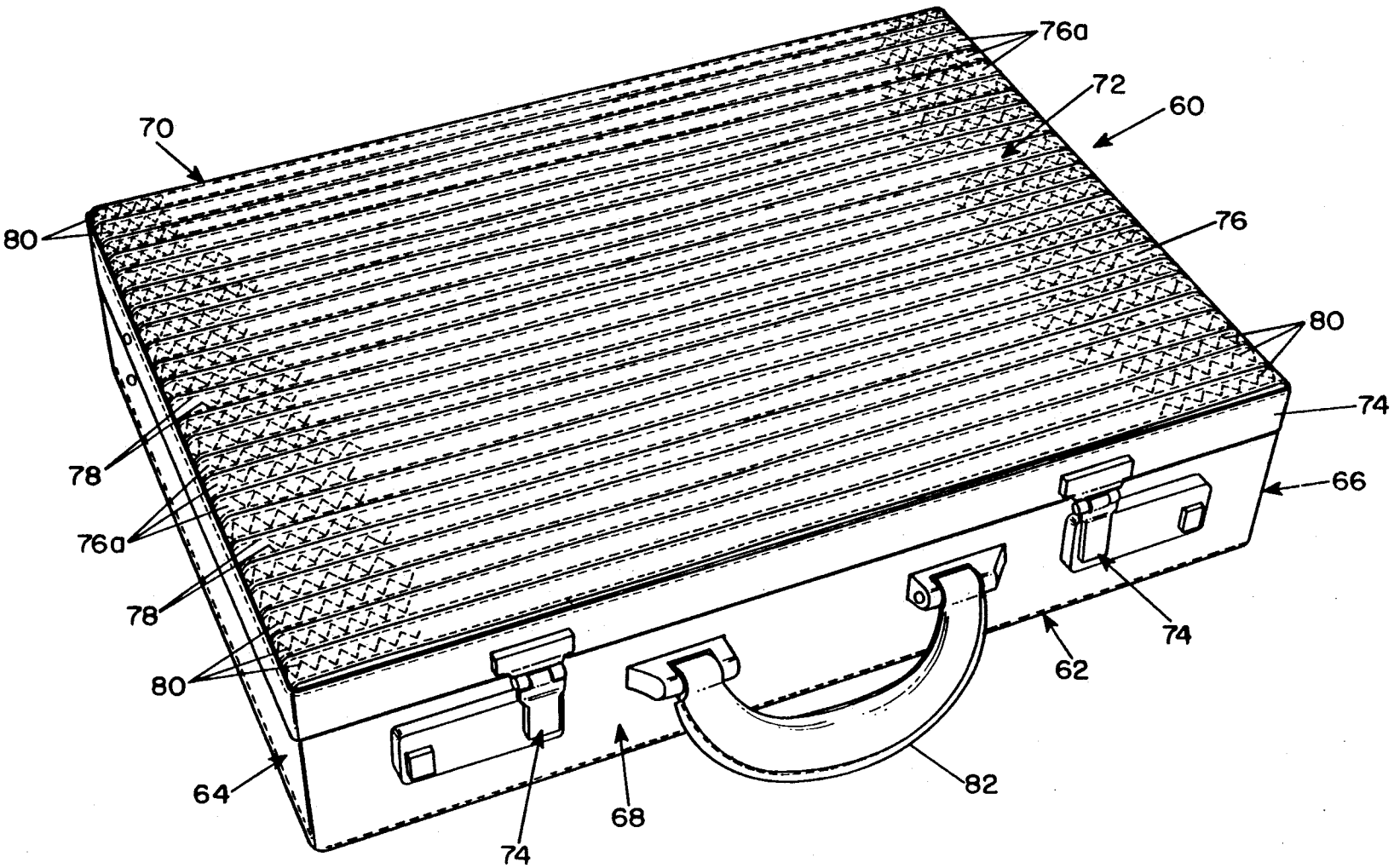

The embodiment of FIG. 3 is a briefcase 60, which is also exemplary of a range of carrying bags, such as travel bags and portfolios. The briefcase has a bottom wall 62, end walls 64 and 66 and front and back walls 68 and 70, all of which are substantially rigid and may be constructed in any suitable manner of any suitable materials. Natural leather, or a covering of natural leather is preferred, but synthetic leather and other materials and forms of construction conventional in the art can be used. The top wall 72 of the briefcase is hinged to the back wall 70, and latches 74 hold the top wall closed, again in a conventional manner. The top wall 72 includes a rigid frame portion 74 and a panel 76 of composite material of the type described above fastened along its entire perimeter to the frame portion. In particular, the panel 76 includes a sheet of a stretch-knit fabric (not visible in FIG. 3, but see FIGS. 4 to 6) and a multiplicity of strips 76a of a durable, substantially non-extensible material, preferably natural or synthetic leather. Each strip 76a is turned under along each side edge and stitched (stitch lines 78) to form hems and is joined to the fabric element 76a by zig-zag stitching 80, only portions of which are shown in the drawing, that runs along the center of each strip and is set in from each side of the strip. The strips of the embodiment are about one-half inch wide and are placed very nearly edge to edge, say with about 1/16th inch or less spacing. The briefcase has a conventional carrying handle 82 attached to the front wall.

When the briefcase is less than completely filled, the composite material retains its shape due to the shape-imparting property imparted to the composite material by the strips, together with the fact that the frame portion of the top is rigid. When the briefcase is filled beyond its initial volume, the panel stretches by stretching of the fabric element in the regions between the zig-zag stitches of the adjacent strips (portions of the fabric that underlie the edges of the strips). Because the frame is rigid, stretching of the fabric element is inhibited near the front, back and end edges of the panel but can occur increasingly in regions nearer the center. The stretching is predominantly in a direction transverse to the strips, inasmuch as the strips are only moderately extensible. The strips can bow outwardly and displace laterally relative to each other, however, with only a small elongations, thus permitting the top wall of the briefcase to bulge and enable an increase in the volume. The strips, in combination with the constraint provided by the rigid frame, control the stretching of the fabric element of the composite material.

In all embodiments of the invention, including the numerous variations and modifications not described or shown herein, the strips impart shape to the bag, control the stretching of the fabric element of the composite material, provide the main load support to contain the articles in the bag, and impart durability to the stretchable wall (or portion of a wall).

Among the variations of the embodiments are:

- carrying bags that have relatively soft and flexible, but substantially non-extensible walls, to which one or more panels of the composite material are joined to form all or part of a wall or walls and having zippered closures;
- briefcases having top and bottom walls, either or both of which may be of the composite material, and joined by soft, substantially non-extensible side and end walls or gussets and having a zippered closure;
- carrying bags with two sections, one or both of which have an extensible wall of the composite material, and walls of either rigid of soft material;
- carrying bags that have a section with rigid walls and a section with soft walls, one or both of which have a wall or part of a wall of the composite material.

In variations similar to the briefcase of FIG. 3, the extensible wall of the composite material will usually be one of the major walls, but it is possible to use the composite material in the side and end walls with the strips running peripherally with respect to the major walls so that the major walls can displace toward and away from each other in a manner similar to the handbag of FIG. 2. In such designs, transverse lateral restraint can be provided at the corners to prevent overstretching.

I claim:

1. A carrying bag having external walls defining a receptacle for objects comprising at least one extensible panel forming at least a part of the external walls of the bag, the extensible panel being of a composite material composed of a sheet of a stretch-knit fabric and a multiplicity of elongated strips of a durable, substantially non-extensible material joined to the fabric sheet in closely spaced relation by stitching spaced apart from the edges of the strips, thereby leaving portions of the fabric sheet underlying the major portions of the strips free to stretch.

2. A carrying bag according to claim 1 wherein the extensible panel has opposite ends oriented transversely to the strips and opposite sides oriented transversely to the ends and wherein the ends of the extensible panel are joined to members forming portions of the bag that are substantially non-extensible so that stretching of the ends of the extensible panel in a direction transverse to the strips is substantially prevented.

3. A carrying bag according to claim 2 wherein the extensible panel is joined along its ends and sides to members that are substantially non-extensible and are inhibited from displacing relative to each other such that they restrict stretching of the extensible panel.

4. A carrying bag according to claim 3 having opposite side walls, opposite end walls, a top wall and a bottom wall, each of which walls is substantially rectangular, and wherein the extensible panel forms substantially all of at least one of the top and bottom walls.

5. A carrying bag according to claim 4 wherein the side and end walls of the bag are substantially rigid such that they restrict stretching of the extensible panel by inhibiting relative displacements of its ends and sides.

6. A carrying bag according to claim 4 wherein the side and end walls of the bag are substantially non-extensible and flexible such that they can displace relative to each other to permit the extensible panel to stretch by enabling relative displacements of its ends and sides but also inhibit stretching of the extensible panel by substantially preventing stretching along the edges and sides of the extensible panel.

7. A carrying bag according to claim 1 having a top wall and a bottom wall bounded by smoothly curved margins and a peripheral wall joined to the top and bottom walls, the peripheral wall being the extensible panel of the bag.

8. A carrying bag according to claim 7 wherein the extensible panel has opposite ends oriented transversely to the strips and opposite sides oriented transversely to the ends and wherein the ends of the peripheral wall are joined to the top and bottom walls of the bag and the strips extend transversely to the top and bottom walls.

9. A carrying bag according to claim 8 wherein the bottom wall is substantially rigid and further comprising a carrying strap attached to the bottom wall of the bag.

10. A carrying bag according to claim 9 wherein the carrying strap is integral with oppositely located strips of the extensible panel.

11. A carrying bag according to claim 1 having a substantially rigid bottom wall bounded by a smoothly curved margin and a peripheral wall joined to the bottom wall, the peripheral wall being the extensible panel of the bag.

12. A carrying bag according to claim 11 wherein the extensible panel has opposite ends oriented transversely to the strips and opposite sides oriented transversely to the ends and wherein one side of the peripheral wall is joined to the bottom wall of the bag and the strips extend peripherally.

13. A carrying bag according to claim 12 and further comprising a carrying strap affixed to the bottom wall.

14. A carrying bag according to claim 13 wherein a strip of the extensible panel adjacent the top of the bag has a multiplicity of holes and further comprising a drawstring passing through the holes and forming a drawstring closure for the bag.

15. A composite material composed of a sheet of a stretch-knit fabric and a multiplicity of elongated strips of a durable, substantially non-extensible material joined to the fabric sheet in closely spaced relation by stitching spaced apart from the edges of the strips, thereby leaving portions of the fabric sheet underlying the major portions of the strips free to stretch.

16. A composite material according to claim 15 wherein the elongated strips are natural leather.

17. A composite material according to claim 15 wherein the elongated strips are synthetic leather.

* * * * *